United States Patent [19]

Feenan et al.

[11] 4,027,643

[45] June 7, 1977

[54] OIL COOLER CONTROL

[76] Inventors: Patrick J. Feenan, 19123 Community St., Northridge, Calif. 91324; Edward B. Walton, 3129 Yale Ave., Marina del Rey, Calif. 90291

[22] Filed: Aug. 14, 1975

[21] Appl. No.: 604,560

[52] U.S. Cl. ..... 123/196 AB; 123/41.33; 184/6.22

[51] Int. Cl.[2] ..... F01M 1/00

[58] Field of Search ..... 123/196 AB, 41.33; 184/6.22, 104 B

[56] References Cited

UNITED STATES PATENTS

| | | | |
|---|---|---|---|
| 2,275,576 | 3/1942 | Ware | 123/196 AB |
| 2,288,599 | 7/1942 | Ramsaur | 123/196 AB |
| 2,584,877 | 2/1952 | Hoffman | 123/196 AB |
| 2,731,239 | 1/1956 | Andersen | 123/196 AB |
| 2,788,176 | 4/1957 | Andersen | 123/41.33 |
| 2,809,810 | 10/1957 | Carroll | 123/196 AB |
| 2,840,068 | 6/1958 | Booth | 123/196 AB |
| 3,147,823 | 9/1964 | Killackey | 123/196 AB |

*Primary Examiner*—Carroll B. Dority, Jr.
*Assistant Examiner*—Daniel J. O'Connor

[57] ABSTRACT

An oil cooler control for the cooling of lubricating oil especially advantageous for engines of relatively low horsepower operating at relatively high R.P.M. makes use of a thermal responsive bypass valve device for altering the path of oil circulation over a cooling coil. The valve device has a valve chamber with a valve seat intermediate opposite ends and a valve element cooperates with the seat in response to a thermal drive element. When the oil is cool most of the oil is passed from the engine through the chamber and directly back to the engine. As the oil temperature increases the valve element is seated causing the oil to be passed through a cooling coil and then back to the engine.

6 Claims, 4 Drawing Figures

OIL COOLER CONTROL

In conventional four cycle engines for example oil serves the purpose of both lubrication and cooling. When oil in the engine gets too hot during operation the effect on the engine is detrimental. Cooling installations have been in use but those currently available employ a cooling coil through which the oil flows constantly. Under such circumstances it takes the engine much too long to warm up from a cold start because the cooling coil is constantly operating even when the body of oil is already cool.

The tendency of most engines in current use is for them to run for long periods of time in traffic in which event the engine tends to get much too hot. Engines of recreation vehicles frequently are overloaded becasue of the towing of auxiliary vehicles and extra heavy loads carried by the vehicle.

Still another factor in present day engine operation is to design the motors to run at a greater number of revolutions per minute to get the necessary horse power and this factor also tends to cause heating up of the engine.

It is therefore among the objects of the invention to provide a new and improved cooling system for engine oil which remains substantially closed off while the engine is cold but which permits the cooling coil to be cut into the system when the temperature of the oil reaches a preset amount.

Another object of the invention is to provide a new and improved oil cooling system for combustion engines wherein oil in the cooling coil is always available for lubrication purposes adding to the capacity of the lubricating system but wherein the cooling coil is effectively bypassed by the system until an engine started from a cold condition reaches a desired temperature.

Also included among the objects of the invention is to provide a new and improved cooling system for engine oil which is capable of cutting off cooling effect when weather conditions are such that oil in the system is already at a temperature cooler than good working conditions require.

With these and other objects in view, the invention consists of the construction, arrangement, and combination of the various parts of the device, whereby the objects contemplated are attained, as hereinafter set forth, pointed out in the appended claims and illustrated in the accompanying drawings.

Figure 1:
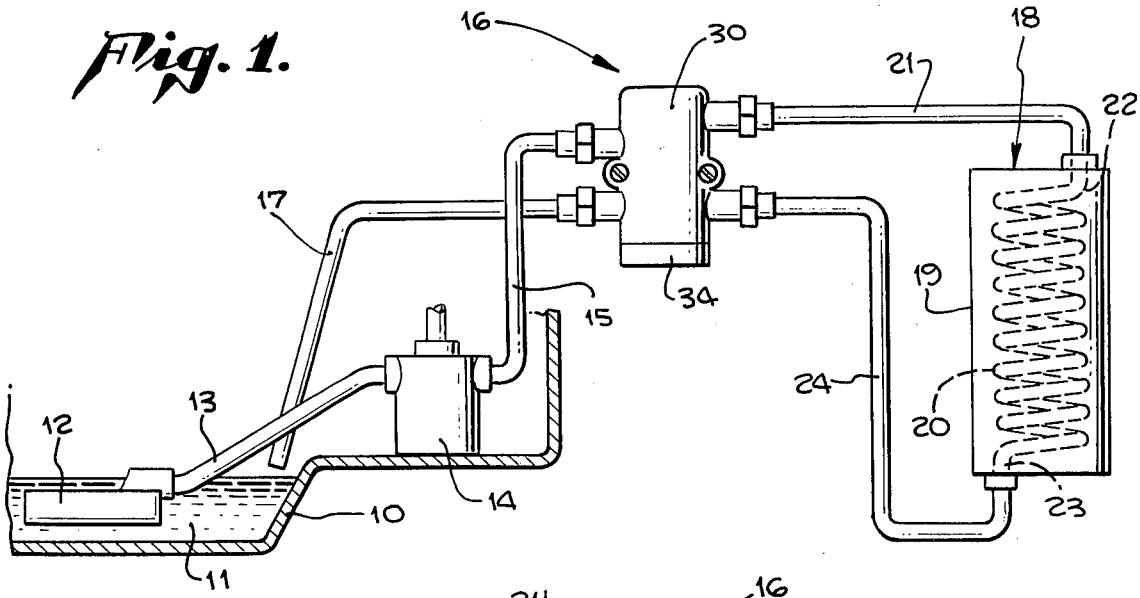
FIG. 1 is a side elevational view of the system in diagramatic form.

In an embodiment of the invention chosen for the purpose of illustration there is shown in an engine housing 10 providing a reservoir 11 of oil. There is an oil intake 12 in the reservoir connected by a pump intake line 13 to a substantially conventional oil pump 14. An oil supply line 15 from the pump connects to one end of a valve device indicated generally by the reference character 16. An oil return line 17 is connected at the other end of the valve device and discharges into the reservoir 11.

A cooler indicated generally by the reference character 18 consists of a housing 19 and a cooling coil 20. A cooling coil intake line 21 connects between one end of the valve device 16 and a corresponding intake end 22 of the cooling coil 20. At a discharge end 23 of the cooling coil 20 there is a cool oil discharge line 24 which connects to the valve device 16 at the end opposite from the connection of the cooling coil intake line 21.

The valve device 16 consists in the main of a housing 30 which provides a chamber 31. The chamber 31 is relatively long in relation to its diameter, one end of which is formed by a bottom wall 32 and the other end of which is formed by an inside wall 33 of a screw cap 34.

Intermediate opposite ends of the chamber there is provided an annular valve seat 35 which is actually a shoulder formed from the material of the housing 30. Opposite chamber portions 32' and 31'' are separated from each other by the valve seat.

A supply port 36 is in communication with the oil supply line 15 to which it is attached by means of a conventional fitting 37. The supply port is adjacent the bottom wall 32. Still more closely adjacent the bottom 32 is a cooling coil sypply port 38 connected to the cooling coil intake line 21 by one of the fittings 37. At the opposite end of the chamber is a cool oil port 39 which is connected to the cool oil discharge line 24 by another one of the fittings 37.

Figure 2:
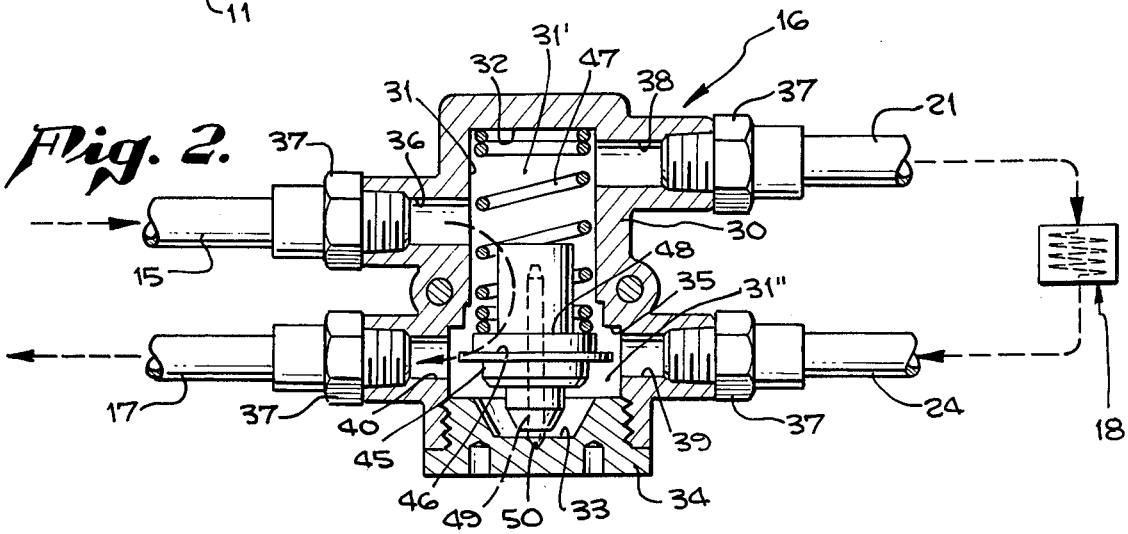
FIG. 2 is a longitudinal sectional view through the control valve device of the system showing the condition of operating parts while the engine is warming up.

An oil return port 40, diametrically opposite the cool oil port 39 as shown in FIG. 2, connects to the oil return line 17 by means of another one of the fittings 37.

Figure 3:
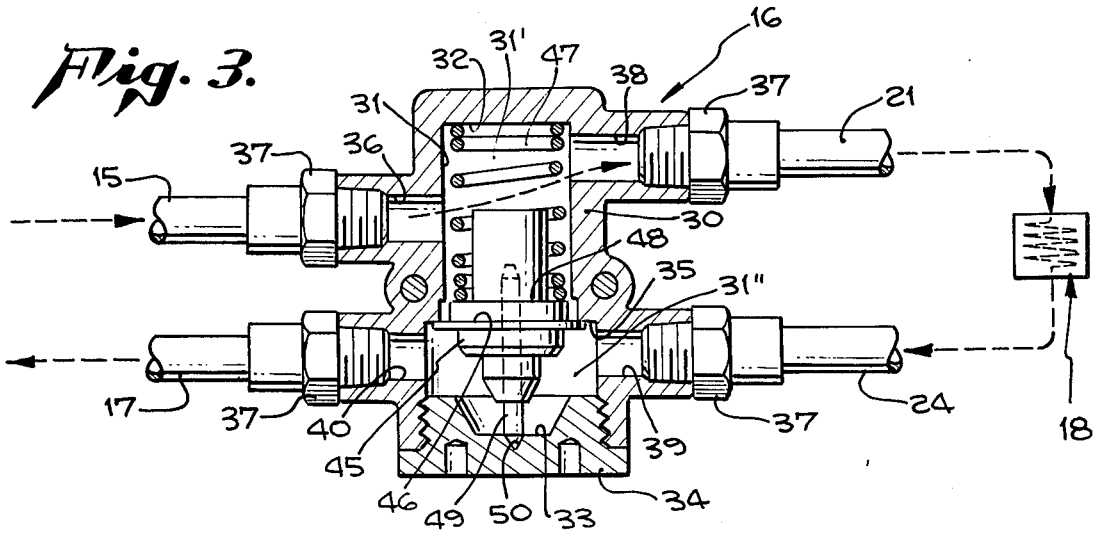
FIG. 3 is a longitudinal sectional view similar to FIG. 2 but showing the position of parts when the cooling coil is in operation.

Located in the chamber 31 is a valve member 45 on the circumference of which is an annular valve element 46. The valve element 46 is adapted to seat on the annular valve seat 35 in certain positions of adjustment. A coil spring 47 bears against the bottom wall 32 at one end and at the other end the coil spring bears against a shoulder 48 on the valve member 45. A piston 49 of the valve member 45 has its outer end centered in a recess 50 in the inside wall 33 of the screw cap 34. The other end of the piston 49 extends into the valve member. Following conventional practice for thermally responsive pistons of this kind conventional materials and structure within the valve member when they reach a preset specified temperature force the piston 48 outwardly with respect to the valve member 45 and the result of this outwardly forcing action is to press the valve member and the shoulder of 48 against the coil spring 47 building up energy in the coil spring while the valve element 46 seats upon the valve seat 35 as shown in FIG. 3. When a preset lower temperature is reached pressure on the piston 49 diminishes and the energy stored in the spring 47 then pushes the valve member 45 toward the position shown in FIG. 2 wherein the valve element 46 is unseated.

In operation when the engine is cold the valve member will occupy the position shown in FIG. 2 with the valve element unseated. Under this condition oil supplied to the chamber by the pump 14 through the oil supply line 15 flows into the chamber and then downwardly as shown in FIG. 2 to the oil return port 40 and thence outwardly through the oil return line 17 to the reservoir 11. When the engine is started oil flows in the direction described and this oil will be substantially at ambient temperature. Although the cooling oil port 38 is open permitting oil to pass to the cooler 18 and thence from the cooler back through the cool oil port 39 which is also open there is substantial resistance to the flow of oil provided by the coil 20 meaning that the path of least resistance is directly through the chamber to the oil return port 40. Consequently, even with this flow condition prevailing substantially all or at least by far the greatest part of the oil is returned directly to the reservoir during the warm up period.

After oil from the engine reservoir reaches the temperature for which the valve member is set the valve member will then act by extension of the piston 49 to seat the valve element 46 against the seat 35 as previously described. When this condition prevails all of the oil from the oil supply line 15 into the chamber 31 will pass directly to the cooling coil intake line 21 and then to the cooler 18. After being cooled by action of the cooler and its coil 20, the oil thus cooled upon returning to the chamber through the cool oil discharge line 24 then passes across the corresponding end of the chamber directly to the oil return port 40 and oil return line 17 to the reservoir 11.

When engine operation stops and the oil cools off the valve member 45 will return to the position of FIG. 2. It should be appreciated however that under some temperature conditions when oil in the reservoir 11 cools even during engine operation the valve member will again operate to release pressure against the piston 49 whereupon the coil spring 47 will have the opportunity to unseat the valve element 46 from the valve seat 35. It is of course anticipated that the unseating may not be for the full distance thereby throttling to a degree the passage of oil between the supply port 36 and the oil return port 40 by virtue of which some, but not all, oil may be passed through the cooling coil 20 for partial cooling. The flexible character of the structural parts are such that there is an automatic control of the temperature of the oil whereby the oil is cooled when cooling is needed, for any reason, and where conversely the oil is permitted to warm up when the temperature of the oil gets too low.

Figure 4:
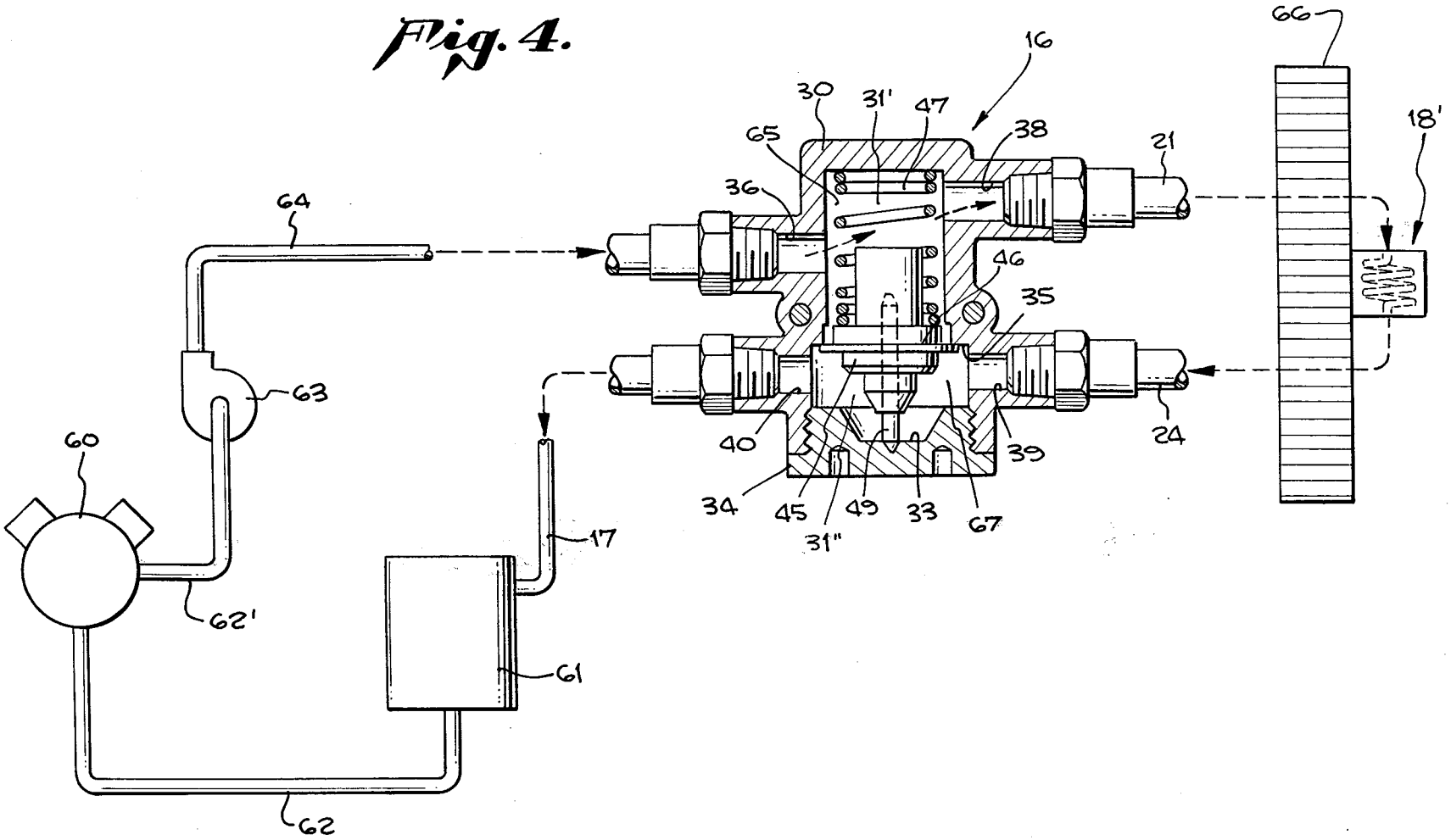
FIG. 4 is a diagrammatic view showing the system used in a dry sump installation.

In the form of the system shown in FIG. 4 a combustion engine 60 operates with a dry sump. Oil for the engine is carried in a tank 61 connected to the engine by an oil line 62 which extends from the bottom of the tank 61 to the bottom of a crank case (not shown) or comparable part of the engine 60.

After circulating through those parts of the engine and picking up heat as the result of engine operation, oil from the engine leaves through an oil line 62′ assisted in its flow by, for example, a pump 63. Although the pump 63 is shown separately for the purpose of illustration, it should be understood the conventional engine oil pump may be relied upon.

The valve device 16 is the same as was described with respect to FIGS. 1, 2, and 3 and operates similarly in that warm or hot oil from an oil supply line 64 is directed into an upper portion 65 of the chamber 31 where the oil temperature can immediately affect a more sensitive part 46 of the valve member 45.

When the valve element 46 is seated on the valve seat, the hot oil is passed through the cooling intake line 21 to a cooling coil 18′ which is located adjacent to a conventional radiator 66 in the path of cooling air which passes through the radiator.

After cooling, the oil flows back to a lower portion 67 of the chamber 31 through the cool oil discharge line 24, and thence through the cool oil return line 17 to the tank 61. When oil is cold, the valve member 45 opens and oil bypasses the coil 18′ in the same manner as has been previously described. The last described form of the engine is one especially advantageous for use on motorcycles.

The cooling system is also directly applicable to the differential and to the transmission of a vehicle for cooling oil as used in the differential and the transmission by a separate cooling system. It would of course not be feasible to use the same cooling system for engine oil, transmission oil, and differential oil because they are of different types.

Having described the invention what is claimed as new in support of Letters Patent is as follows:

1. In a combustion engine temperature responsive system for passing lubricating oil from the combustion engine alternatively either directly back to the engine or through a cooling coil prior to return to the engine,
   - a valve device comprising a housing having a valve chamber therein,
   - an oil supply passage for oil from the engine to the chamber,
   - an oil return passage for oil from the chamber to the engine,
   - a cooling coil intake passage for oil from the chamber to the cooling coil and a cool oil discharge passage for oil from the cooling coil to the chamber,
   - said chamber having adjoining side wall structures of different diameters substantially cylindrically shaped at opposite ends, and end walls for the respective side wall structures,
   - an annular valve seat extending around an interior wall of said chamber at the junction of the side wall structure for one end with the side wall structure for the other end, whereby the portion of the valve seat of smallest diameter is no smaller than the diameter of the smaller of said side wall structures,
   - a valve member comprising a housing and a thermal responsive reciprocating piston element, said housing having an annular valve element thereon at the outermost perimeter in operable association with said seat,
   - said thermal responsive reciprocating piston element in said valve member having an operating engagement between said housing and said valve member and responsive to temperature changes in said oil,
   - resilient means in one of said side wall structures acting between the end wall therefor and said valve element in a direction normally holding said valve element in an unseated condition whereby to substantially bypass said coil,
   - said reciprocating piston element having movement in a direction to overcome tension in said spring and to seat said valve element on said seat when oil temperature is relatively high.

2. A temperature responsive system as in claim 1 wherein said valve seat comprises the portion of the wall of said chamber intermediate said side wall structures.

3. A temperature responsive system as in claim 1 wherein said valve element comprises a portion of the housing of said valve member.

4. A temperature responsive system as in claim 1 wherein said chamber has a length in excess of the length of said valve member and wherein said resilient means comprises a coil spring having one end surrounding and bearing against the housing of said valve member, the other end of the spring being parallel to said one end and having a bearing against an end wall of said chamber whereby to comprise the guiding means for the movement of said valve member during reciprocating movement of said housing.

5. A temperature responsive system as in claim 1 wherein the bulk of said valve member lies on the side of said valve element adjacent the portion of the chamber in communication with the oil supply passage whereby to be immediately responsive to temperature changes in said supply passage.

6. A temperature responsive system as in claim 1 wherein said resilient means is an open coil spring located within the side wall structure which adjoins said oil supply passage, said coil spring having an outside diameter less than the diameter of the corresponding side wall structure and greater than the diameter of the housing for said valve member whereby to enable substantially unrestricted flow of oil through said chamber, said spring being bottomed at one end on the end wall for the side wall structure in which it is located and at the other end on the housing adjacent said valve element.

* * * * *